US010992020B1

(12) United States Patent
Singleton et al.

(10) Patent No.: US 10,992,020 B1
(45) Date of Patent: Apr. 27, 2021

(54) DIELECTRICALLY BOOSTED VERY LOW FREQUENCY ANTENNA

(71) Applicant: LOS ALAMOS NATIONAL SECURITY, LLC, Los Alamos, NM (US)

(72) Inventors: John Singleton, Los Alamos, NM (US); Andrea Caroline Schmidt, Los Alamos, NM (US); Frank L. Krawczyk, Los Alamos, NM (US)

(73) Assignee: U.S. Department of Energy, Washington, DC (US)

( * ) Notice: Subject to any disclaimer, the term of this patent is extended or adjusted under 35 U.S.C. 154(b) by 342 days.

(21) Appl. No.: 16/120,090

(22) Filed: Aug. 31, 2018

Related U.S. Application Data

(60) Provisional application No. 62/579,767, filed on Oct. 31, 2017.

(51) Int. Cl.
*H01Q 1/38* (2006.01)
*H01Q 1/12* (2006.01)

(52) U.S. Cl.
CPC ..... *H01Q 1/1242* (2013.01); *H01Q 1/38* (2013.01)

(58) Field of Classification Search
CPC ..... H01Q 1/12; H01Q 1/38
USPC ..... 343/874
See application file for complete search history.

(56) References Cited

U.S. PATENT DOCUMENTS

2005/0168385 A1* 8/2005 Baker ..... H01Q 1/1242 343/700 MS
2010/0053021 A1* 3/2010 Renfro ..... H01Q 1/1242 343/890
2014/0104136 A1* 4/2014 Werner ..... H01Q 1/364 343/900
2018/0198536 A1* 7/2018 Smolyaninov ..... H04B 7/0617

OTHER PUBLICATIONS

James, J. R., et al., Electrically short monopole antennas with dielectric or ferrite coatings, Proc. IEE, vol. 125, No. 9, Sep. 1978, pp. 793-803, 11 pages.
Hamad, Hawzheen et al., Size Reduction of Mobile Monopole Antenna using Magnetic Coating, Canadian Journal on Electrical and Electronics Engineering. vol. 2, No. 2, Feb. 2011, pp. 43-46, 5 pages.
Wang, Chao-Fu, et al., Electrically Small Magneto-Dielectric Coated Monopole Antenna at HF Band, 2012 IEEE Asia-Pacific Conference on Antennas and Propagation, Aug. 27-29, 2012, Singapore, 2 pages.

* cited by examiner

*Primary Examiner* — Andrea Lindgren Baltzell
(74) *Attorney, Agent, or Firm* — Lewis Roca Rothgerber Christie LLP

(57) ABSTRACT

A very low frequency (VLF) antenna includes a metal monopole and a dielectric metamaterial cladding surrounding a periphery of the monopole.

19 Claims, 3 Drawing Sheets

DIELECTRICALLY BOOSTED VERY LOW FREQUENCY ANTENNA

CROSS-REFERENCE TO RELATED APPLICATION

The present application claims priority to and the benefit of U.S. Provisional Patent Application Ser. No. 62/579,767, filed on Oct. 31, 2017, the entire content of which is incorporated herein by reference.

STATEMENT REGARDING GOVERNMENT RIGHTS

The United States government has rights in this invention pursuant to Contract No. DE-AC52-06NA25396 between the United States Department of Energy and Los Alamos National Security, LLC for the operation of Los Alamos National Laboratory.

FIELD

Aspects of embodiments of the present disclosure relate to a dielectrically boosted very low frequency (VLF) antenna.

BACKGROUND

Very low frequency (VLF) radio transmissions are generally defined as radio transmissions having a frequency in a range of about 3 to about 30 kilohertz (kHz), which is referred to as the "VLF band." The VLF band frequencies, that is, frequencies in a range of about 3 to about 30 kHz, correspond to wavelengths of about 100 to about 10 kilometers, respectively. Due to its low frequency and correspondingly limited bandwidth, the VLF band is primarily used to transmit low-data-rate coded signals because audio and/or video communication via the VLF band is impracticable.

Although the VLF band has relatively limited bandwidth, it is well-suited for very-long-range communication. First, because VLF radio signals have large wavelengths (e.g., about 10 to about 100 kilometers), they can diffract around large obstacles, including man-made structures and mountain ranges. Further, VLF radio signals are readily propagated over long distances due to the Earth-ionosphere waveguide mechanism. The ionosphere is a conductive layer of electrons and ions at about 60 to about 90 kilometers altitude above the Earth, and the ionosphere reflects VLF radio signals back toward Earth. Because both the ionosphere and the Earth are conductive, VLF radio signals are reflected between the ionosphere and the Earth, creating a waveguide a few wavelengths high, allowing VLF radio signals propagate very long distances, up to about 20,000 kilometers from the emission source.

Due to its various limitations (e.g., limited bandwidth) and advantages (e.g., very-long-distance propagation), the VLF band is used for radio navigation services, government time radio stations, and secure communications. Because VLF radio signals can penetrate at least 40 meters of saltwater, the VLF band is one method of secure communications between land-based stations and deployed submarines. By communicating via VLF radio signals, land-based stations and deployed submarines can communicate with each other without requiring the submarine to surface, thereby ensuring the submarine's position remains hidden from reconnaissance assets, including radar, ships, aircraft, and reconnaissance satellites.

However, due to the relatively large wavelengths of VLF radio signals (i.e., about 10 to about 100 kilometers) and because VLF radio signals propagate vertically (e.g., are vertically polarized) with respect to the Earth, ideal VLF antennas would be the same height as the wavelength of the emitted VLF radio signals. Due to materials limitations and air traffic concerns, a 10-100 kilometer tall antenna is not feasible, and even a quarter-wave antenna designed to emit VLF radio signals at 30 kHz would be about 2.5 kilometers high. As such, existing VLF antennas are electrically short, that is, they are a small fraction of a wavelength tall. Thus, existing VLF antennas are relatively inefficient, radiating only about 10% to 50% of the transmitted power. Accordingly, high power transmitters are paired with the existing VLF antennas to compensate for the low efficiency of existing VLF antennas and to enable long distance communication.

SUMMARY

Aspects of embodiments of the present disclosure are directed toward a dielectrically boosted very low frequency (VLF) antenna. A VLF antenna according to embodiments of the present disclosure includes a metal monopole surrounded by a foam-based dielectric metamaterial. The foam-based dielectric metamaterial may include a polymer foam and a plurality of copper structures interspersed within the polymer foam. The dielectric metamaterial dramatically improves the emission efficiency of the monopole without the cost and weight associated with traditional hard dielectric materials, such as alumina, allowing the VLF antenna to be used without the traditional antenna tower array elements.

According to an embodiment of the present disclosure, a very low frequency (VLF) antenna includes a monopole including a metal and a dielectric metamaterial cladding surrounding a periphery of the monopole.

The dielectric metamaterial cladding may include a polymer foam and a plurality of copper structures interspersed within the polymer foam, and an outer diameter of the dielectric metamaterial cladding may be in a range of about 10 meters to about 30 meters.

The monopole may include copper.

The monopole may be in a range of about 200 meters to about 300 meters tall.

The dielectric metamaterial cladding may be a cast material.

The VLF antenna may further include an outer shell surrounding a periphery of the dielectric metamaterial cladding, and the dielectric metamaterial cladding may be a granular material encased within the outer shell.

The outer shell may include concrete or a polymer material.

According to another embodiment of present disclosure, a very low frequency (VLF) antenna tower array includes: a central tower includes a metal monopole and a dielectric cladding surrounding a periphery of the metal monopole; a plurality of outer towers arranged around the central tower; and a plurality of conductive wires extending between the central tower and the outer towers. The conductive wires are electrically connected to the metal monopole.

The dielectric cladding may include a polymer foam and a plurality of copper structures interspersed within the polymer foam, and an outer diameter of the dielectric cladding may be in a range of about 10 meters to about 30 meters.

The central tower may be in a range of about 200 meters to about 300 meters tall.

The metal monopole may include copper.

The dielectric cladding may include a plurality of cast sections stacked on each other.

The central tower may further include an outer shell surrounding a periphery of the dielectric cladding, and the dielectric cladding may be a granular material encased within the outer shell.

According to another embodiment of the present disclosure, a very low frequency (VLF) antenna includes: a metal monopole in a range of about 200 meters to about 300 meters tall and configured to emit radio signals having a frequency in a range of about 3 to about 30 kilohertz; and a foam-based dielectric cladding surrounding a periphery of the metal monopole.

The VLF antenna may further include an outer shell surrounding a periphery of the foam-based dielectric cladding, and the outer shell may include concrete or a polymer.

The foam-based dielectric cladding may include a polymer foam and a plurality of copper structures interspersed within the polymer foam.

The foam-based dielectric cladding may have a height that is at least 90% the height of the metal monopole, and an outer diameter of the foam-based dielectric cladding may be in a range of about 10 meters to about 30 meters.

The VLF antenna may further include a cap covering an upper end of the metal monopole and an upper end of the foam-based dielectric cladding.

The foam-based dielectric cladding may have a density in a range of about 0.05 g/cm$^3$ to about 0.4 g/cm$^3$.

The foam-based dielectric cladding may have a dielectric constant in a range of about 3 to about 6 for frequencies in a range of about 0 to about 10 GHz.

BRIEF DESCRIPTION OF THE DRAWINGS

These and other aspects and features of the present disclosure will be further appreciated and better understood with reference to the specification, claims, and appended drawings, in which:

DETAILED DESCRIPTION

The detailed description set forth below in connection with the appended drawings is intended as a description of example embodiments of the present disclosure and is not intended to represent the only forms in which the present disclosure may be embodied. The description sets forth aspects and features of the present disclosure in connection with the illustrated embodiments. It is to be understood, however, that the same or equivalent aspects and features may be accomplished by different embodiments, and such other embodiments are encompassed within the spirit and scope of the present disclosure. As noted elsewhere herein, like element numbers in the description and the drawings are intended to indicate like elements. Further, descriptions of features, configurations, and/or other aspects within each embodiment should typically be considered as available for other similar features, configurations, and/or aspects in other embodiments.

Due to materials limitations and size restrictions, including air traffic concerns, VLF antennas are height limited, such that VLF antennas are generally not even a quarter of a wavelength of a VLF radio signal tall (i.e., about 2.5 kilometers tall for a 30 kHz antenna). To balance radiation efficiency (or emission efficiency) with size and materials limitations, typically VLF antennas are about 200 meters to about 300 meters tall. Because about 200 meters to about 300 meters is a small fraction of a wavelength of a typical VLF radio signal, typical VLF antennas are electrically small (e.g., are electrically small antennas (ESAs)). To compensate for their small height and correspondingly reduced emission efficiency, VLF antennas are often part of an antenna array that increases overall emission efficiency.

Figure 1:
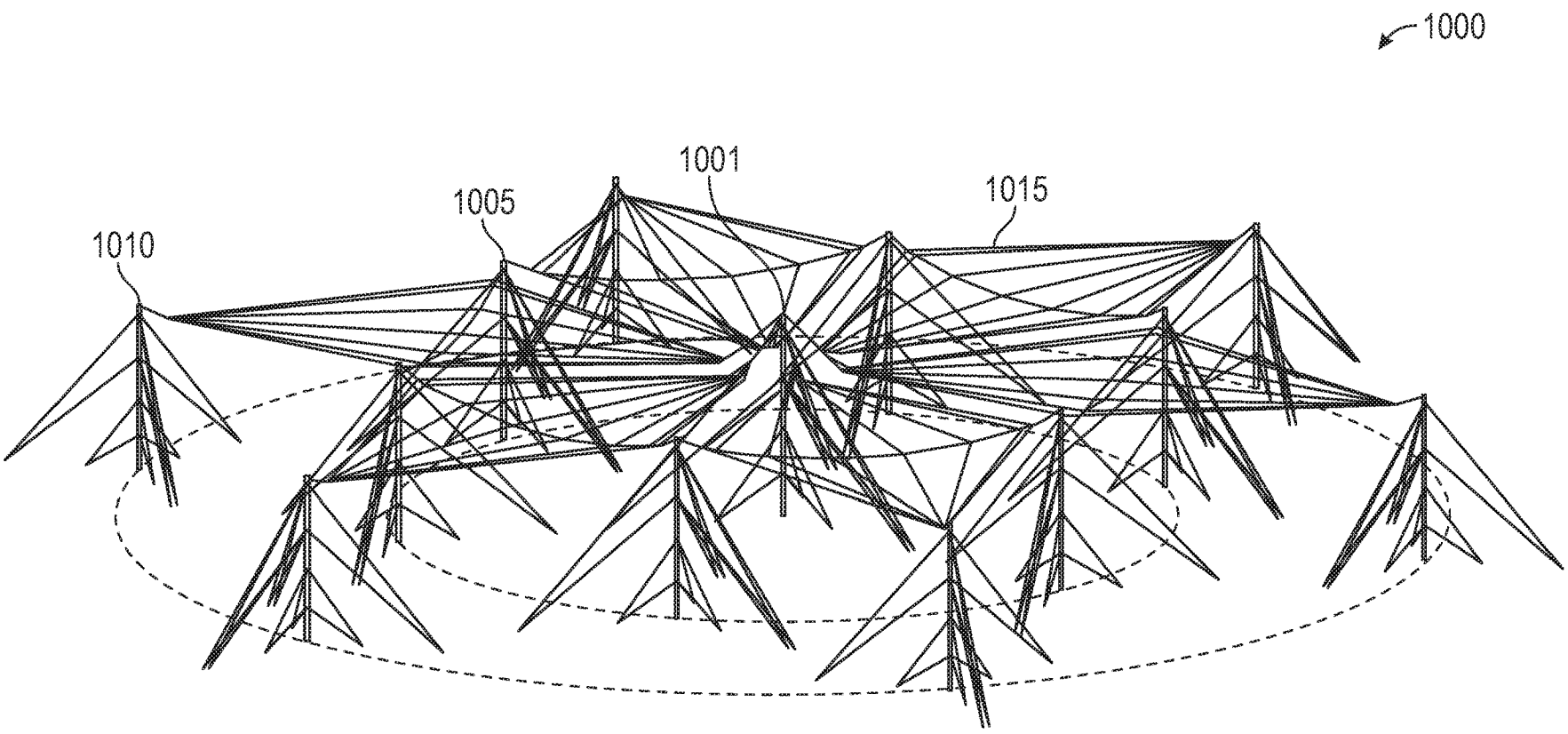
FIG. 1 (Related Art)
FIG. 1 is a schematic view of a very low frequency (VLF) antenna tower array according to the related art.

A very low frequency (VLF) antenna tower array 1000 according to the related art is shown in FIG. 1. The VLF antenna tower array 1000 according to the related art includes a central tower (e.g., a central monopole) 1001, a plurality of inner towers 1005 arranged around the central tower 1001, and a plurality of outer towers 1010 arranged around the central tower 1001 and the inner towers 1005. The inner towers 1005 may be about 500 meters from the central tower 1001, and the outer towers 1100 may be about 1,000 meters from the central tower 1001. The towers 1001/1005/1010 may be made of a conductive metal.

The central tower 1001 and/or the inner and outer towers 1005/1010 may be radio masts acting as radiators for emitting a VLF radio signal. The towers 1001/1005/1010 may be about 200 meters to about 300 meters tall and, therefore, are electrically small antennas. To compensate for the relative small size of the radiators compared to the radiated signals, a plurality of wires or cables 1015 may be electrically connected to the central tower 1001 and may extend between tops of the central, inner, and outer towers 1001/1005/1010. The wires 1015 form a capacitive top-load to increase the radiation efficiency of the towers 1001/1005/1010.

In some instances, the VLF antenna tower array 1000 according to the related art may include a counterpoise system arranged between the ground and the wires 1015. The counterpoise system is often arranged a few feet above the ground and includes a network of copper cables or wires to reduce or minimize power dissipated from the wires 1015 to the ground. The arrangement of copper cables may form a "carpet" of copper cables just above the ground.

The VLF antenna tower array 1000 according to the related art is large, spanning over a mile in diameter, and includes multiple towers 1001/1005/1010 and wires 1015, making the VLF antenna tower array 1000 expensive and time-consuming to construct. Due to its large footprint, the VLF antenna tower array 1000 according to the related art is easily spotted by reconnaissance assets, such as imaging satellites, rendering such structures vulnerable in times of conflict, especially in light of their role in communicating with deployed nuclear-capable submarines. Due to these considerations, there are currently only a few operational VLF antenna tower arrays in the United States, making them very important strategic assets. Accordingly, there is a need for smaller, cheaper, and more efficient VLF antennas that can be more easily manufactured and hidden.

Figure 2:
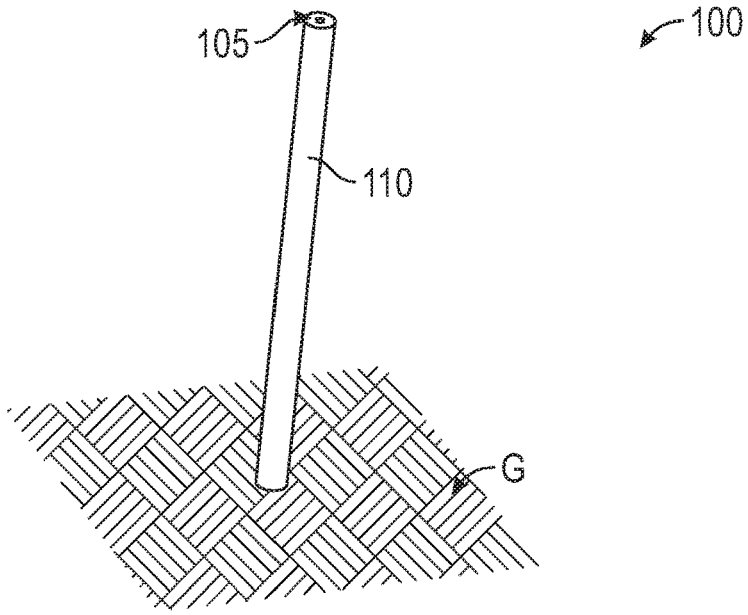
FIG. 2 is a schematic view of a VLF antenna according to an embodiment of the present disclosure.
Figure 3:
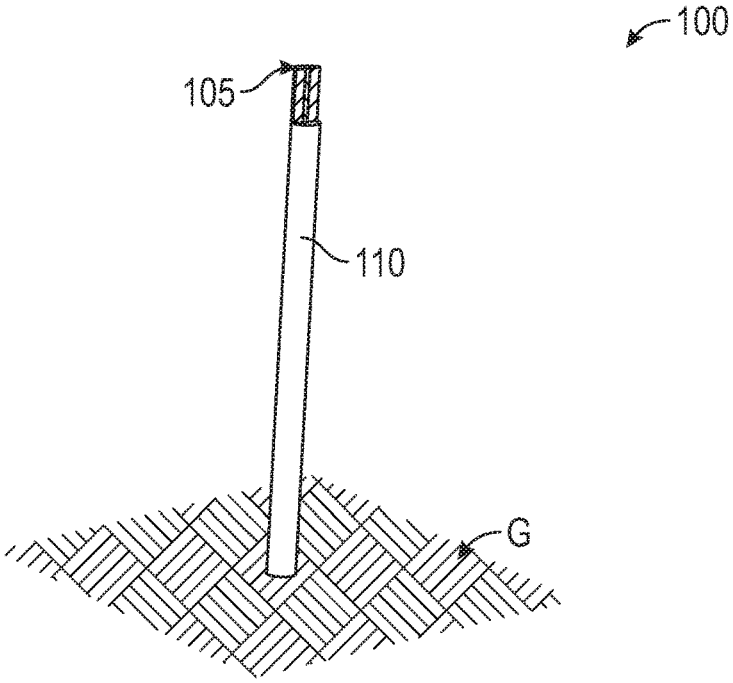
FIG. 3 is a cut-away schematic view of the VLF antenna shown in FIG. 2.

Referring to FIGS. 2 and 3, a VLF antenna tower 100 according to an embodiment of the present disclosure includes a monopole (e.g., a monopole radiator) 105 and a dielectric cladding 110 around (e.g., surrounding a periphery of) the monopole 105. The monopole 105 may include (or made of) a conductive metal, such as copper, aluminum, or steel, and may be mounted to the ground G (e.g., the monopole 105 may be connected to the Earth as a ground or may be insulated from the Earth and connected to a separate ground). The monopole 105 may about 200 meters to about 300 meters tall and may have a diameter of about 30 centimeters; however, the present disclosure is not limited thereto. The height of the monopole 105 may be determined according to the desired radiating frequency as would be understood by one skilled in the art, and the diameter of the monopole 105 may be determined based on material strength to be self-supporting given its height. For example, the monopole 105 may be about 200 meters tall when it is to radiate a 15 kHz signal, and the height of the monopole 105 may be suitably suitably varied to efficiently operate at different frequencies in the range of about 3 kHz to about 30 kHz.

An outer diameter of the dielectric cladding 110 may be in a range of about 10 to about 30 meters, but the present disclosure is not limited thereto. The dielectric cladding 110 may extend at least 90% of the height of the monopole 105 and, in some embodiments, may extend the entire length (or height) of the monopole 105. Related art dielectric materials, such as alumina, have generally not been applied to VLF antennas owing to the high cost and weight of alumina and the tall height of VLF antennas. Alumina, generally, has a density of about 3.95 g/cm$^3$, making even a relatively thin coating of alumina on a 200 meter tall monopole prohibitively heavy. Thus, using alumina or similar hard dielectric materials as a dielectric cladding on a monopole has been discounted because it would be prohibitively expensive and would greatly increase the weight of the antenna.

According to embodiments of the present disclosure, the dielectric cladding 110 includes (or is) a dielectric metamaterial, e.g., a foam-based dielectric metamaterial. For example, the dielectric cladding 110 may be a polymer foam including meso-scale (e.g., mesoscopic) copper structures interspersed throughout. The density of the foam-based dielectric metamaterial according to embodiments of the present disclosure may be in a range of about 0.05 to about 0.4 g/cm$^3$, compared with about 3.95 g/cm$^3$ for alumina, and may be about 1-3% the cost of a comparable alumina dielectric. The dielectric constant of the dielectric cladding 110 may be varied from about 3 to about 6 for frequencies in a range of about 0 to about 10 GHz by suitably altering the shape of the copper structures in the polymer foam as would be understood by those skilled in the art. The loss tangent of the foam-based dielectric metamaterial may be similar to that of hard dielectric materials known in the art, such as alumina or the like, while being substantially cheaper and less dense than such hard dielectric materials. The emission efficiency of the monopole 105 is increased due to volume-distributed polarization currents that flow through the dielectric cladding 110, thereby greatly improving the emission efficiency of the monopole 105, as further described below.

Figure 4:
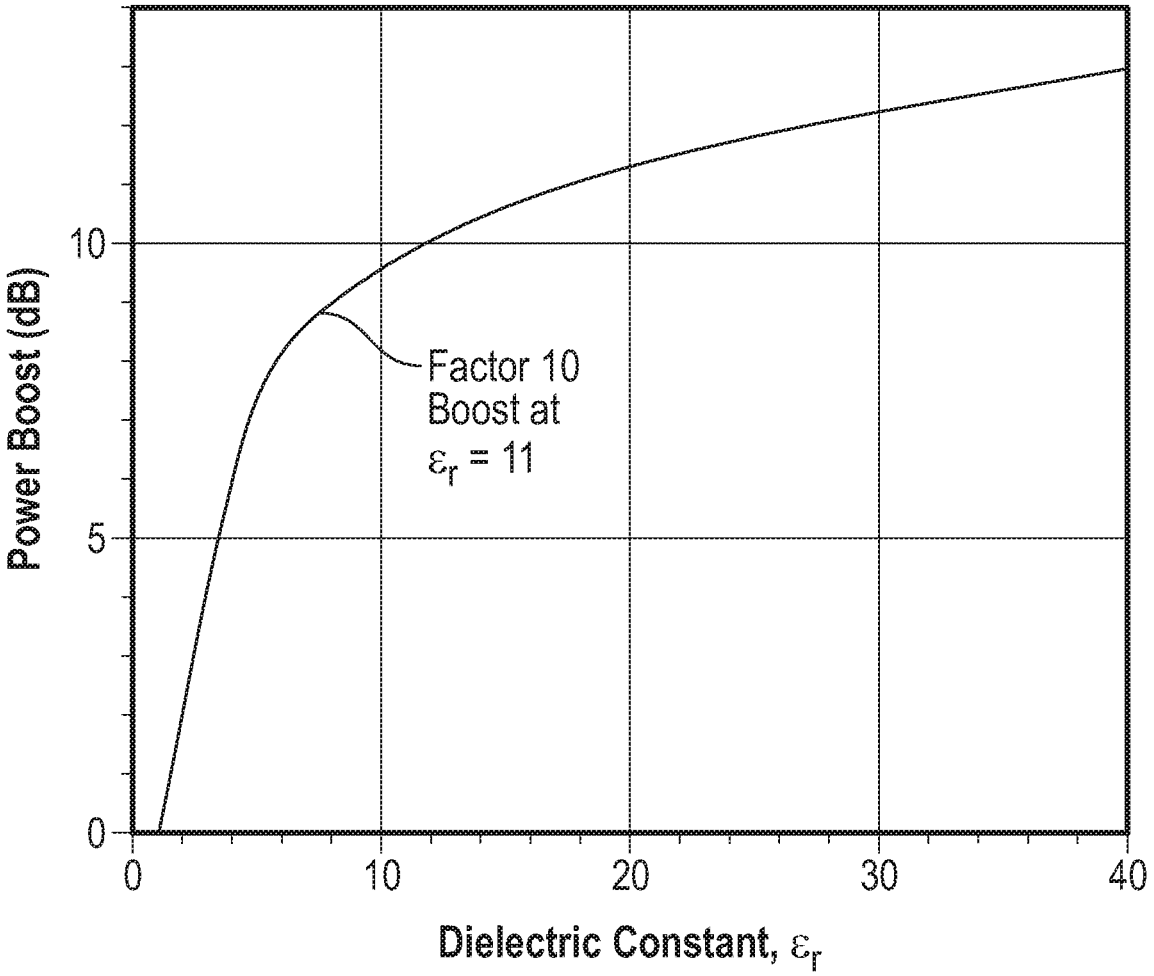
FIG. 4 is a graph of power boost as a function of the dielectric constant of a dielectric material of a VLF antenna according to an embodiment of the present disclosure.

Referring to FIG. 4, when the foam-based dielectric metamaterial has a dielectric constant of about 3.5, the output power of the VLF antenna 100 is increased by a factor of about 3 compared to a naked monopole (e.g., a monopole without a dielectric cladding). As another example, when the foam-based dielectric metamaterial has a dielectric constant of about 6, the output power of the VLF antenna 100 is increased by a factor of about 6.3. And when the dielectric constant of foam-based dielectric metamaterial is increased to about 11, the output power of the VLF antenna 100 is increased by a factor of about 10. In the VLF antenna tower array according to the related art, efficiency gains of a few percent are considered outstanding. Accordingly, boosting the power output of a VLF antenna by a factor of about 10, achievable according to embodiments of the present disclosure, is game-changing by allowing the VLF antenna 100 to be used without the attendant array components, such as the towers 1005 and 1010 and wires 1015 shown in FIG. 1.

The dielectric cladding 110 may be cast (e.g., formed to be installed around the monopole 105) or provided as granules about 2 millimeters in diameter for packing around the monopole 105. When the dielectric cladding 110 is cast, it may be cast as a plurality of individual parts that are stacked onto the monopole 105. For example, each part of the cast dielectric cladding 110 may have a donut shape to fit over the monopole 105, and the pieces of the cast dielectric cladding 110 may be stacked onto the monopole 105 at or near the final installation site. When the dielectric cladding 110 is provided as granules, an outer shell may be provided around the monopole 105 to house the granules. The outer shell may include (or may be made of) concrete, a polymer, etc. (e.g., any material that does not absorb or substantially absorb radio waves) and may be left open at the top for the granules to be poured in. Similarly, an outer shell may also be included when the dielectric cladding 110 is cast to protect the dielectric cladding 110 against the elements, such as wind, rain, and sunlight. A cap may be provided at the top of the VLF antenna 100 after the dielectric cladding 110 is installed to further protect it from the elements.

Due to the substantial improvement in radiation efficiency provided by the dielectric cladding 110, an efficient VLF antenna 100 may be provided without including the surrounding towers (e.g., the inner and outer towers 1005/1010 shown in FIG. 1), the external wires (e.g., the wires 1015 shown in FIG. 1), and/or the counterpoise system described above. By providing a self-contained, efficient VLF antenna without requiring an external structure or array (e.g., the towers 1005/1010, the wires 1015, and/or the counterpoise system described above with reference to FIG. 1), the major drawbacks of VLF antenna tower arrays according to the related art, such as being large and costly, are overcome by the VLF antenna 100 according to embodiments of the present disclosure.

Further, the VLF antenna 100 according to embodiments of present disclosure may be easily concealed from traditional reconnaissance assets. For example, the VLF antenna 100 having a height of about 200 to about 300 meters and a diameter of about 10 to about 30 meters may be easily disguised as an industrial smokestack or the like. Because the VLF antenna 100 may be efficiently employed as a VLF antenna without being part of a large tower array, such as the VLF antenna tower array 1000 shown in FIG. 1, due to the foam-based dielectric cladding 110, a number of redundant VLF antennas 100 can be installed over a large geographic area, ensuing reliable performance.

In some embodiments, the VLF antenna 100 including the dielectric cladding 110 may be used as the central tower of the VLF antenna tower array 1000 shown in FIG. 1. In this embodiment, the output efficiency of the VLF antenna tower array is further improved by using the VLF antenna 100 including the dielectric cladding 110 as the central tower. The wires 1015 of the VLF antenna tower array may be connected to a top of the monopole 105 that is exposed above the dielectric cladding 110, or the wires 1015 may extend through the dielectric cladding 110 to be connected to the monopole 105.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art. As used herein, the term "major component" means a component constituting at least half, by weight, of a composition, and the term "major portion", when applied to a plurality of items, means at least half of the items.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the terms "exemplary" and "example" are intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although example embodiments of a mid-1R optical waveguide and a method of manufacturing the same have been described and illustrated herein, many modifications and variations within those embodiments will be apparent to those skilled in the art. Accordingly, it is to be understood that a mid-IR optical waveguide and a method of manufacturing the same according to the present disclosure may be embodied in forms other than as described herein without departing from the spirit and scope of the present disclosure. The present disclosure is defined by the following claims and equivalents thereof.

What is claimed is:

1. A very low frequency (VLF) antenna comprising:

a monopole comprising a metal; and a dielectric metamaterial cladding surrounding a periphery of the monopole, the dielectric metamaterial cladding comprising a polymer foam and a plurality of copper structures interspersed within the polymer foam.

2. The VLF antenna of claim 1, wherein an outer diameter of the dielectric metamaterial cladding is in a range of about 10 meters to about 30 meters.

3. The VLF antenna of claim 2, wherein the monopole comprises copper.

4. The VLF antenna of claim 3, wherein the monopole is in a range of about 200 meters to about 300 meters tall.

5. The VLF antenna of claim 2, wherein the dielectric metamaterial cladding is a cast material.

6. The VLF antenna of claim 2, further comprising an outer shell surrounding a periphery of the dielectric metamaterial cladding, and wherein the dielectric metamaterial cladding is a granular material encased within the outer shell.

7. The VLF antenna of claim 6, wherein the outer shell comprises concrete or a polymer material.

8. A very low frequency (VLF) antenna tower array comprising:

a central tower comprising a metal monopole and a dielectric cladding surrounding a periphery of the metal monopole, the dielectric cladding comprising a polymer foam and a plurality of copper structures interspersed within the polymer foam;

a plurality of outer towers arranged around the central tower; and a plurality of conductive wires extending between the central tower and the outer towers, the conductive wires being electrically connected to the metal monopole.

9. The VLF antenna tower array of claim 8, wherein an outer diameter of the dielectric cladding is in a range of about 10 meters to about 30 meters.

10. The VLF antenna tower array of claim 9, wherein the central tower is in a range of about 200 meters to about 300 meters tall.

11. The VLF antenna tower array of claim 10, wherein the metal monopole comprises copper.

12. The VLF antenna tower array of claim 9, wherein the dielectric cladding comprises a plurality of cast sections stacked on each other.

13. The VLF antenna tower array of claim 9, wherein the central tower further comprises an outer shell surrounding a periphery of the dielectric cladding, and wherein the dielectric cladding is a granular material encased within the outer shell.

14. A very low frequency (VLF) antenna comprising:

a metal monopole in a range of about 200 meters to about 300 meters tall and configured to emit radio signals having a frequency in a range of about 3 to about 30 kilohertz; and a foam-based dielectric cladding surrounding a periphery of the metal monopole, the foam-based dielectric cladding comprising a polymer foam and a plurality of copper structures interspersed within the polymer foam.

15. The VLF antenna of claim 14, further comprising an outer shell surrounding a periphery of the foam-based dielectric cladding, the outer shell comprising concrete or a polymer.

16. The VLF antenna of claim 14, wherein the foam-based dielectric cladding has a height that is at least 90% the height of the metal monopole, and wherein an outer diameter of the foam-based dielectric cladding is in a range of about 10 meters to about 30 meters.

17. The VLF antenna of claim 14, further comprising a cap covering an upper end of the metal monopole and an upper end of the foam-based dielectric cladding.

18. The VLF antenna of claim 14, wherein the foam-based dielectric cladding has a density in a range of about 0.05 $g/cm^3$ to about 0.4 $g/cm^3$.

19. The VLF antenna of claim 18, wherein the foam-based dielectric cladding has a dielectric constant in a range of about 3 to about 6 for frequencies in a range of about 0 to about 10 GHz.

* * * * *